US005148820A

United States Patent [19]

Klammer et al.

[11] Patent Number: 5,148,820

[45] Date of Patent: Sep. 22, 1992

[54] PROCESSING OF TOBACCO LEAVES

[75] Inventors: Barbara C. Klammer, Southampton; Roy L. Prowse, Eastleigh, both of England

[73] Assignee: British-American Tobacco Company Limited, London, England

[21] Appl. No.: 580,880

[22] Filed: Sep. 11, 1990

[30] Foreign Application Priority Data

Sep. 18, 1989 [GB] United Kingdom ..... 8921113
Jun. 1, 1990 [GB] United Kingdom ..... 9012234

[51] Int. Cl.[5] ..... A24B 5/10
[52] U.S. Cl. ..... 131/311; 131/290
[58] Field of Search ..... 131/311, 312, 327, 290

[56] References Cited

U.S. PATENT DOCUMENTS 3,696,817 10/1972 Bonner .
3,706,314 12/1972 Smith .
3,861,400 1/1975 Perkins et al. ..... 131/335
3,931,824 1/1976 Miano et al. ..... 131/359
4,248,253 2/1981 Cogbill, II ..... 131/312
4,323,083 4/1982 Cogbill, II ..... 131/312
4,328,816 5/1982 Cogbill, II ..... 131/312
4,557,278 12/1985 Brackmann .

FOREIGN PATENT DOCUMENTS 139007 4/1966 New Zealand .
2134 of 1855 United Kingdom .
413486 7/1934 United Kingdom .
1483082 8/1977 United Kingdom .
2026298A 2/1980 United Kingdom .
2119220A 11/1983 United Kingdom .
2118817B 3/1985 United Kingdom .
2078085B 7/1985 United Kingdom .
2131671A 6/1986 United Kingdom .
2176385A 12/1986 United Kingdom .

*Primary Examiner*—Vincent Millin
*Assistant Examiner*—Lynne A. Reichard
*Attorney, Agent, or Firm*—Kane, Dalsimer, Sullivan, Kurucz, Levy, Eisele and Richard

[57] ABSTRACT

Whole tobacco leaf is fed to a milling machine such that there is produced a mixture of lamina flakes and intact stem lengths. The lamina fraction, with little or no further particle size reduction can be fed to a cigarette making machine. The stem fraction can be discarded or processed according to conventional methods.

45 Claims, 12 Drawing Sheets

PROCESSING OF TOBACCO LEAVES

BACKGROUND OF THE INVENTION

1. Field of the Invention

This invention relates to the processing of tobacco leaf material in the manufacture of smoking articles.

2. Brief Description of Related Art

Tobacco leaves of the types used in the manufacture of cigarettes and like smoking articles comprise leaf lamina, a longitudinal main stem (rib) and veins extending from the main stem. The main stem and large veins are hereinafter jointly referred to as 'stem'. The stem has substantially different physical properties from the lamina, and it is long-established practice to separate the stem from the lamina at an early stage in the processing of tobacco leaves, the stem and lamina then being processed independently and differently.

The manner in which stem material is separated from lamina material is generally by means of a complex and large threshing plant comprising a number, eight for example, of serially arranged threshing machines with classification units disposed intermediate next adjacent threshing machines.

As is well known, the separated stem material, or a proportion of it, after suitable reduction in size, is often added back to the lamina after the lamina has been subjected to further processing. Stem material is often desirable in the tobacco blend to improve fill value.

It is an object of the invention to provide an improved method of processing tobacco leaf material to provide a product suitable for use in smoking articles, cigarettes and cigars for example.

We have looked at ways of simplifying the overall tobacco producing process from leaf to smoking article.

We have found that it is possible to use a mill for the purpose of operating simultaneously on stem and lamina to produce a product useful for incorporation in smoking articles. Whilst we are aware that it has been proposed to use a disc mill to reduce the particle size of stem material on its own, we are not aware of any use of a single mill wherein whole leaf is fed to the mill so as to make possible the provision of a particulate material which is capable of being used for making smoking articles without any substantial further size-reduction process. It has, however, been found to be possible to use a mill with whole leaf, as defined hereinafter, to produce a mixture of particulate lamina material, and substantially intact stem material, the lamina material having a size which makes it suitable for being used, without further substantial size reduction, in the making of smoking articles. Thus, for instance, the lamina material can be fed to a commercial cigarette rod making machine, a Molins Mk 9 for example.

By 'whole leaf' we mean complete, or substantially complete, leaves or leaves which have been reduced in size by a reduction process, such as chopping or slicing for example, that does not involve any significant separation of lamina and stem. The leaves or leaf portions will generally have been cured and may have been subject to other more or less conventional treatments.

Prior proposals for the processing of tobacco leaves to provide filler for cigarettes and like smoking articles are numerous. Examples are to be found in the following patent specifications:

Germany (Federal Republic): 954,136

New Zealand: 139,007

United Kingdom: 1855/2134; 413,486; 2,026,298; 2,078,085; 2,118,817; 2,119,220 and 2,131,671

United States: 55,173; 68,597; 207,140; 210,191; 250,731; 358,549; 360,797; 535,134; 2,184,567; 3,026,878; 3,128,775; 3,204,641; 3,690,328; 3,845,774; 4,195,646; 4,210,157; 4,248,253; 4,323,083; 4,392,501; 4,582,070; 4,696,312 and 4,706,691.

SUMMARY OF THE INVENTION

According to one aspect thereof the present invention provides a method of processing tobacco leaf material, wherein tobacco as whole leaf, as hereinbefore defined, is fed through a mill, the arrangement of said mill and the processing conditions being such that there exits said mill a product which is a mixture comprising flakes of lamina and substantially intact stem pieces, the lamina fraction of said product requiring substantially no further size reduction in order to render the lamina fraction suitable for being incorporated in smoking articles.

According to another aspect thereof the present invention provides a product comprising a mixture of lamina particles and substantially intact stem pieces, which mixture results from the feeding of tobacco whole leaf, as hereinbefore defined, through a mill.

There may be fed to the mill, together with the tobacco whole leaf, additional lamina in the form of lamina strips.

According to a further aspect thereof the present invention provides a method of processing tobacco leaf material to provide smoking article filler material, wherein tobacco as whole leaf, as hereinbefore defined, passes through a passage defined by co-extensive portions of first and second, relatively moving, milling elements of a mill from an inlet of said passage to an outlet of said passage remote said inlet, so as to provide at said outlet a product comprising a mixture of lamina particles and intact stem pieces, the lamina particles and the stem pieces being separated, whereby the lamina particle fraction, absent the stem pieces, constitutes said filler material. Preferably, the outlet of the passage is situated at the margin of the co-extensive portions.

It has been found that the stem fraction of products of the invention is readily separated from the lamina fraction. The separation may, for example, be carried out by air classification.

Advantageously, a gravity feed system is used for feeding the leaf material to the inlet of the mill.

It may, in some cases, be found to be advantageous to inject low pressure steam, at one bar for example, into the leaf reduction apparatus.

The feed of leaf material to the mill may be assisted by the maintenance at the product outlet of the mill of a reduced air pressure, as, for example, by way of use of an air lift, or by the maintenance of an elevated air pressure at the product inlet of the mill.

Preferably, the feed of the leaf material to the mill should be a continuous feed. It is advantageous for the feed rate to be substantially constant.

The leaf material fed to the mill can be, for example, a flue-cured Virginia material, a United States type blended material or an air-cured material.

According to a yet further aspect thereof the present invention provides a smoking article filler material, which filler material is a fluent material consisting of lamina particles, the shape factor of about 70 per cent or more of the dust free particles of the material being 0.5 or above.

The concept of 'shape factor' is defined hereinbelow.

According to a yet further aspect thereof the present invention provides a method of making cigarettes, wherein tobacco bale material is reduced to provide discrete whole leaf, as hereinbefore defined; the whole leaf is fed through a mill such that there exits said mill a product which is a mixture comprising flakes of lamina and substantially intact lengths of stem; the lamina and stem fractions of said mixture are separted; and the lamina fraction is fed to a cigarette rod making machine.

BRIEF DESCRIPTION OF THE DRAWINGS

Each shape factor value shown against the horizontal axes of the histograms constituting FIGS. 3 and 4 is the upper value of a unit range. Thus the value '0.4', for example, signifies that the range extends from the least value above 0.3 up to a maximum of 0.4.

DETAILED DESCRIPTION OF THE PREFERRED EMBODIMENTS OF THE INVENTION

Figure 1:
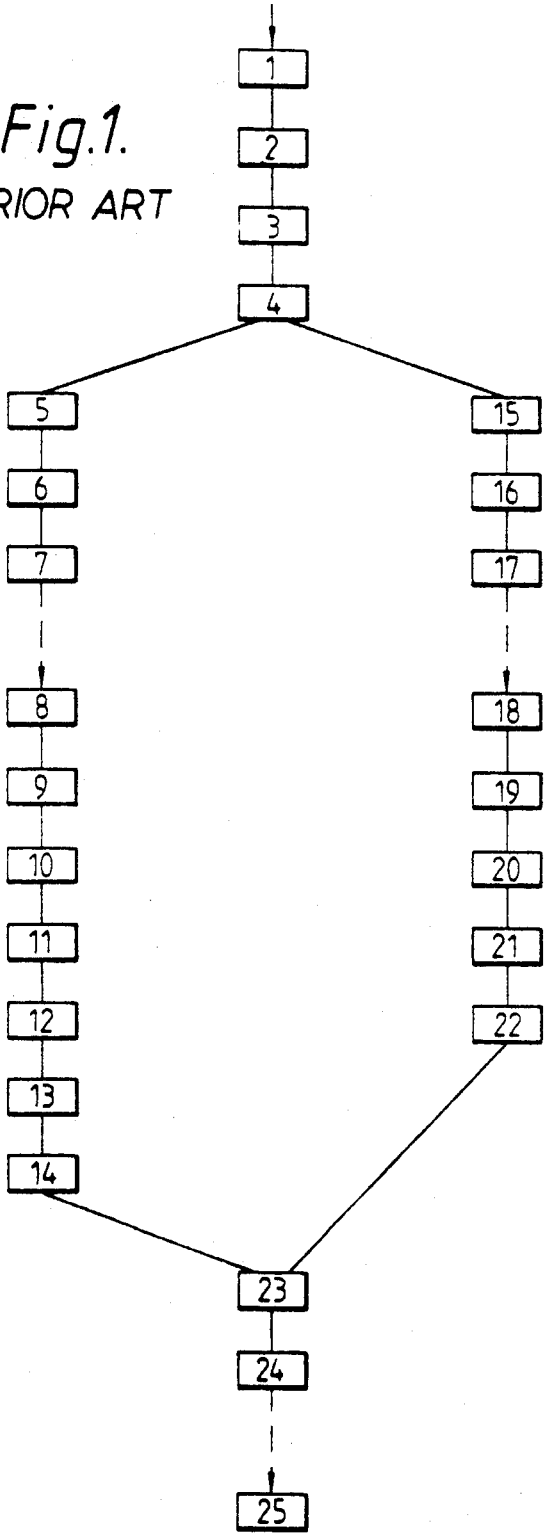
Fig.1. PRIOR ART
FIG. 1 is a block diagram relating to a prior art conventional processing of flue-cured whole tobacco leaf.

Since the moisture content (of the stem fraction) is relatively low, there is a reduced requirement for drying of the product of the size reduction apparatus, which can lead to considerable savings in equipment and energy costs.

A smoke modifying agent, a tobacco casing for example, can be applied to tobacco leaf material before or after the processing thereof by a method in accordance with the invention.

Particulate lamina materials obtained in accordance with the invention can be subjected to a tobacco expansion process. Examples of expansion processes which could be employed are disclosed in United Kingdom Patent Specifications Nos. 1,484,536 and 2,176,385.

It has been found that the moisture content of whole leaf is generally the main factor which determines whether, on the one hand, intact stem pieces are produced, or on the other hand, stem particles are produced, and that, surprisingly, a sharp transition from the one product to the other product occurs at a fairly precise moisture content.

The moisture content at which this transition occurs will hereinafter be referred to as the 'transition moisture content'.

The transition moisture content of a tobacco material to be milled is readily determined by simple experimentation prior to production operation. For a Virginia tobacco whole leaf, when milled in a Quester SM11 mill, the transition moisture content was found to be substantially 18%. That is to say, in this case it is a requirement, if a mixture of lamina particles and intact stem pieces is to be produced from the mill, for the mean moisture content to be less than 18%. Preferably, the moisture content selected should not be of a value far below the transition moisture content. Thus, for example, in a case in which the transition moisture content is 18%, a mean feed moisture content of 16% might be selected.

Heat may be applied to the tobacco material to be milled. If heat is applied, as for example by subjecting the material to microwave radiation, the value of the transition moisture content will tend to be depressed.

Leaf material processed by a method in accordance with the invention may be of a single tobacco grade or a blend of leaf materials of a plurality of tobacco grades.

Since a mill used in carrying out a method in accordance with the invention is substantially more compact than a conventional threshing plant, with its plurality of threshing machines and classifiers and extensive associated air trunking, there will be, in use of our invention, a capital cost saving relative to the use of a conventional threshing plant. There will also be a saving in energy consumption. Furthermore, capital and energy cost savings will accrue from simplification of the primary leaf-process section in the tobacco factory. it is thus the case that by use of the present invention significant savings can be made in the overall tobacco leaf process, i.e. that process which commences with tobacco leaf as received from the farm and which ends with the making of cigarettes or other smoking articles.

It is to be observed that not only does the invention provide methods of providing a mixture of discrete lamina particles and discrete stem pieces, without a requirement for a serially arranged plurality of leaf processing machines, but furthermore, the invention provides methods which are readily carried out without any requirement to recirculate product for further size reduction of the lamina fraction of the mixture. In other words, single pass operation is readily achieved.

Figure 9:
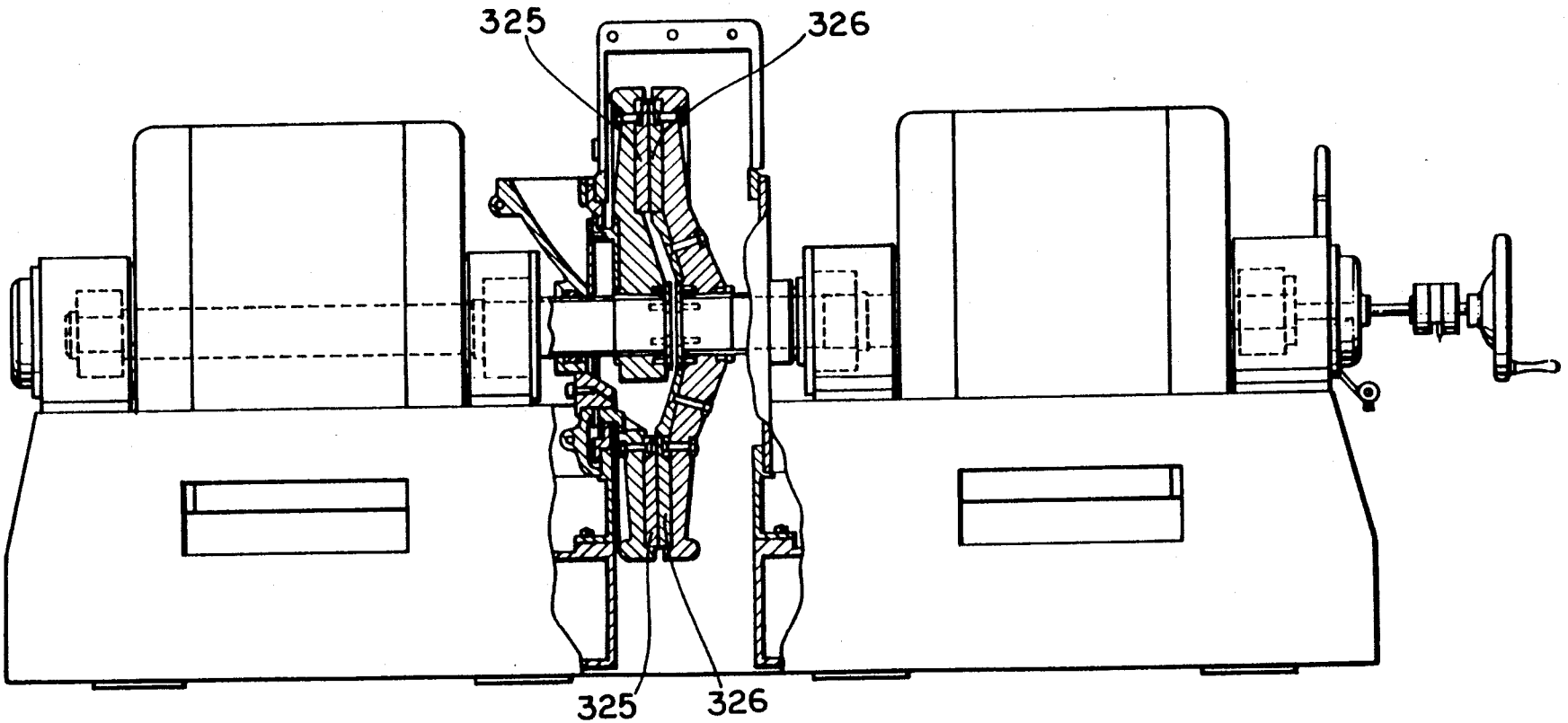
FIG. 9 PRIOR ART
FIG. 9 is a side view, partially sectioned, of a prior art 400 Series Double Revolving Disc Refiner made by The Bauer Bros. Co., Springfield, Ohio.
Figure 11:
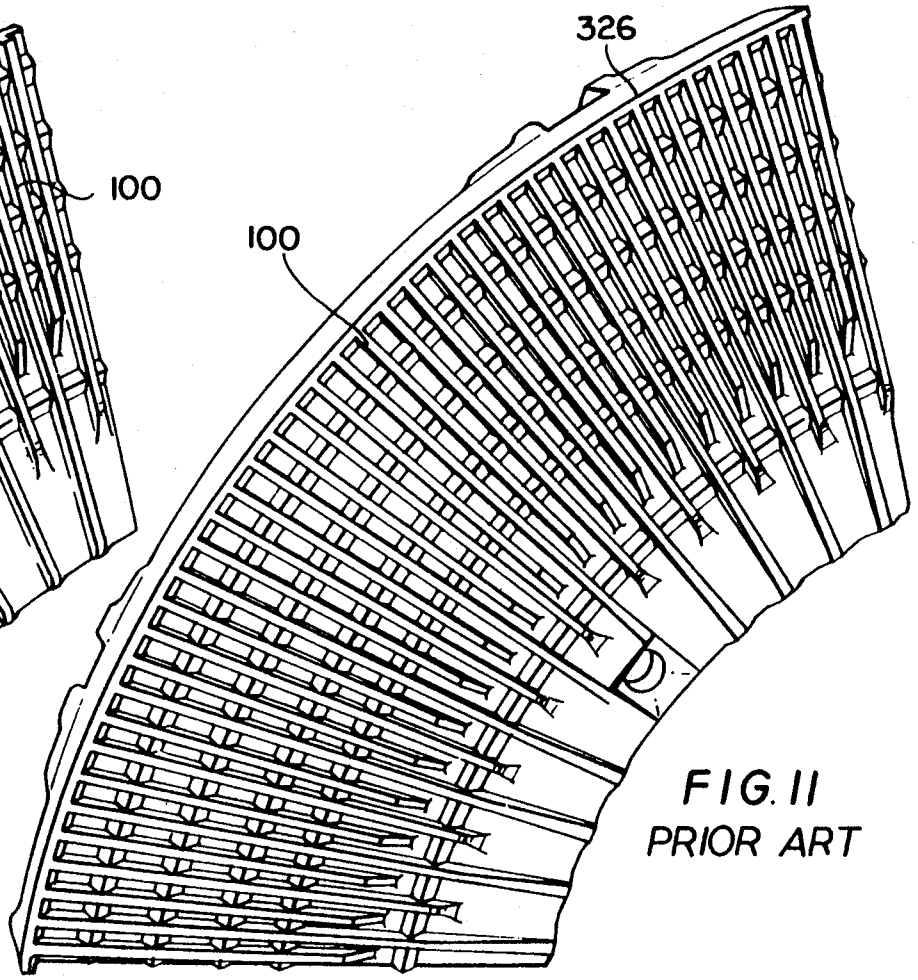
FIG. 11 PRIOR ART
FIG. 11 is a view of a prior art refiner disc plate segment 326 for the refiner of FIG. 9.
Figure 10:
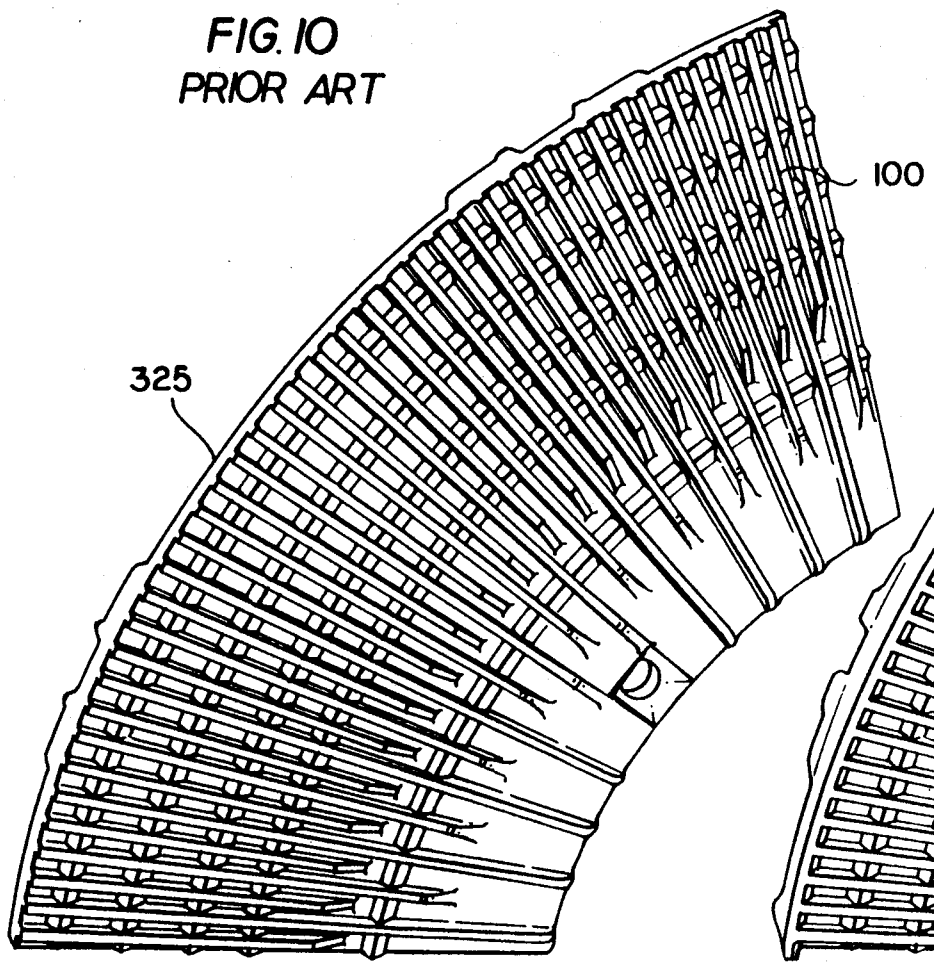
FIG. 10 PRIOR ART
FIG. 10 is a view of a prior art refiner disc plate segment 325 for the refiner of FIG. 9.

Mills used in carrying out methods in accordance with the invention are preferably of the kind in which a material flow path extends between and across opposed faces of first and second leaf reduction elements, such that there is provided a shearing action on tobacco material as the tobacco material traverses the material flow path. The faces may be substantially conoidal. Suitably, at least one of the leaf reduction elements is discoid, in which case it is advantageous that the discoid elements comprise, at the operative face thereof, generally linear, rib-form, radially extending projections. Preferably, both of the leaf reduction elements are discoid. Mills which comprise two leaf reduction elements taking the form of discs are exemplified by the Bauer model 400 (see FIG. 9, a side view partially cutaway) and the Quester model SM II (see FIG. 12, an open mill in-perspective-view). In operation of the Bauer model 400 mill the two discs (325, 326) are driven in opposite directions, whereas in the operation of the Quester model SM II mill one disc is rotated whilst the other remains stationary. A number of discs are available for the Bauer 400 mill, each of which discs is provided with a particular pattern of projections on the operative face thereof. Bauer plates designated 325 and 326 and shown in FIGS. 10 and 11, respectively, as having discoid leaf reduction elements 100 are useful in carrying out the present invention.

In the operation of disc mills for the simultaneous milling of lamina and stem, determinants of the particle size of the lamina fraction of the product are the relative speed of rotation of the discs, the size of the gap between the discs and the configuration of the milling projections at the operative faces of the discs.

It has been found that so-called "mills" of the kind which employ an impact action, such as hammer mills, will not generally be suitable for carrying out the desired milling action.

Figure 13:
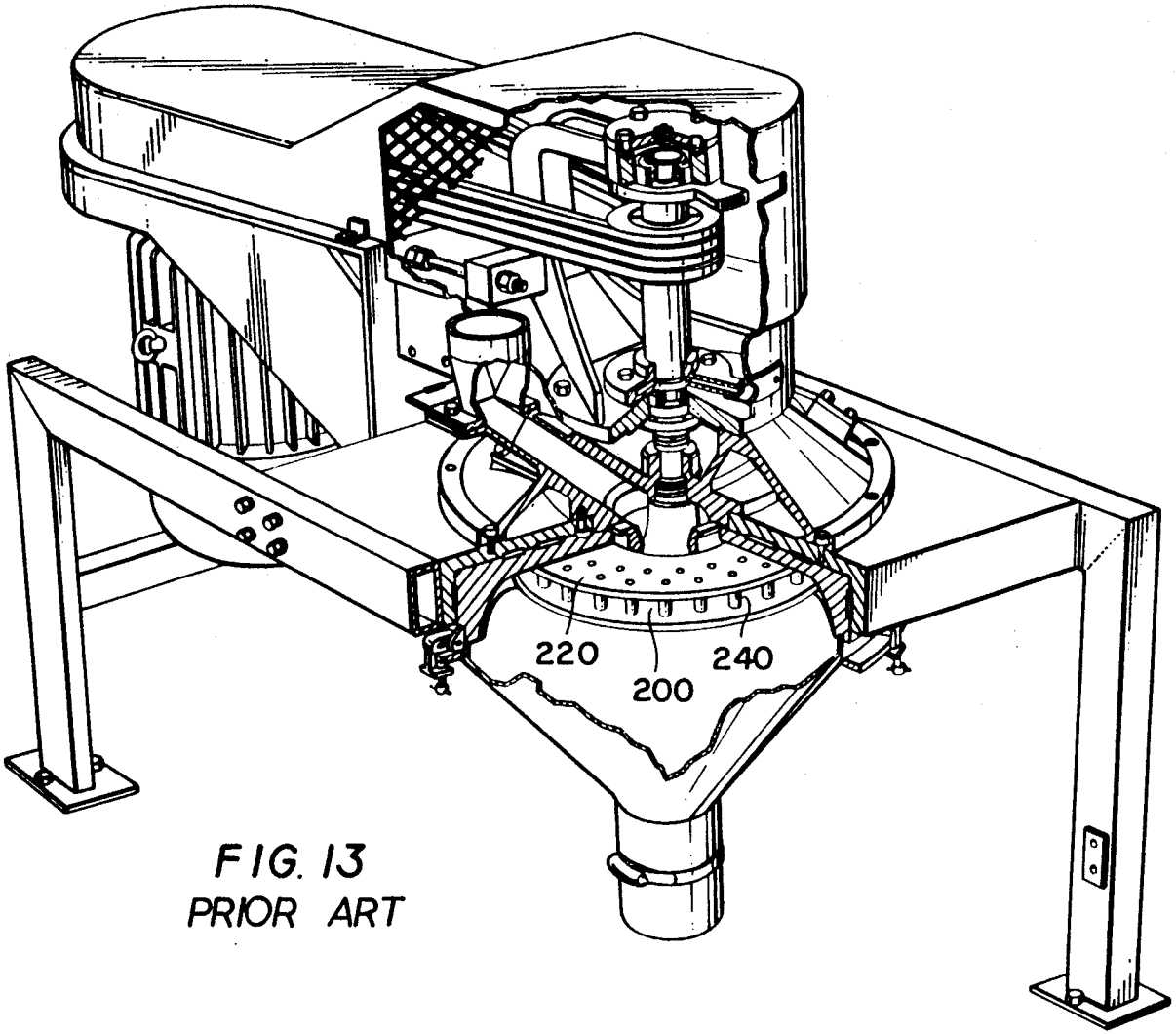
FIG. 13 PRIOR ART
FIG. 13 is a view-in-perspective, partially cut-away, of a prior art Sentry M3 Impact Disrupter.

We have examined a Robinson pin mill (model designation-Sentry M3 Impact Disrupter; see FIG. 13, a view-in-perspective). This mill comprises a rotative disc (200) and a disc-like stator (220), both of which elements are provided with circular arrays of pins (240) extending perpendicularly of the opposing faces of the elements. The pins of one element interdigitate with those of the other element. The limited experience gained with the Robinson pin mill indicated that such a mill might be useful in carrying out methods in accordance with the invention.

Any ageing step may take place in respect of whole leaf as hereinbefore defined or the size-reduced material produced by the size reduction apparatus.

Separated lamina fractions of products of methods in accordance with the invention are fluent materials and generally exhibit an angle of repose of not more than about 45 degrees, or even an angle of repose of not more than about 35 degrees, to the horizontal when at a conventional cigarette making moisture content, 13% say.

It has also been observed of the lamina materials that the shape factor of about 70 per cent or more of the dust free constituent lamina particles is 0.5 or above. The shape factor of about 80 per cent or more of the dust free particles may be 0.5 or above.

$$\text{Shape Factor} = \frac{4\pi \times \text{Area}}{(\text{Perimeter})^2}$$

The shape which has the maximum shape factor value, of one, is a circle.

Figure 14:
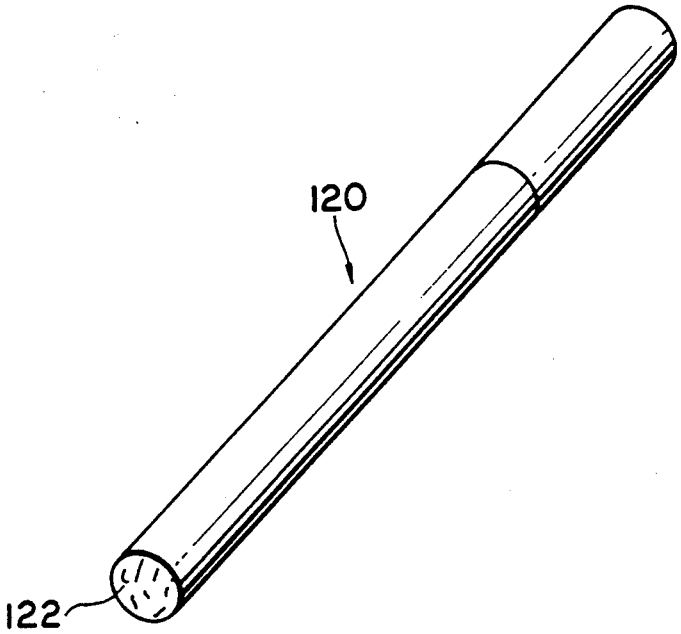
FIG. 14 is a view-in-perspective of a smoking article of the invention.

It has further been observed that generally the Borgwaldt filling value of separated lamina fractions of products of methods in accordance with the invention is less than that of comparable conventional cut tobacco smoking material. It has, however, been found, surprisingly, that the firmness of cigarettes (120); see FIG. 14, a view-in-perspective comprising as a majority proportion of the filler such a separated lamina fraction (122) is comparable to control cigarettes comprising conventional tobacco smoking material.

Lamina materials can be provided by the invention which can be fed to a smoking article making machine without being first subjected to further particle size reduction, or which require at most a minor degree only of further particle size reduction. That is not to say, of course, that a minor proportion of heavy particles and/or a minor proportion of dust size particle may not be removed from the lamina material before incorporation of the material in smoking articles.

When incorporated in cigarettes by having been fed to a cigarette making machine, lamina materials obtained in accordance with the invention have an appearance similar to that of conventional cigarette filler thus incorporated in cigarettes.

Conventional cut filler material which is used in the making of cigarettes is a long stranded, non-fluent, tangled material. For this reason the feed unit of cigarette making machines comprises carding means operative to disentangle the filler material. In that lamina materials obtained in accordance with the invention are fluent, non-tangled materials consisting of lamina particles, when the materials are incorporated in cigarettes the carding means, or at least elements thereof, can be dispensed with.

If a method of processing tobacco whole leaf in accordance with the invention takes place in a tobacco growing region, the leaf material can be so-called "green leaf" material, i.e. cured leaf material as received from the tobacco farm. If, however, the leaf material is to be processed in a tobacco factory remote the tobacco growing region, it may be expedient to subject the tobacco to a socalled redrying process. A redrying process is used in order to ensure that the leaf material is at a low enough moisture content to render the leaf material suitable for transport to and storage at the factory without quality deterioration.

The use of whole tobacco leaf as a starting material for the preparation of smoking article filler material, without the necessity for a prior lamina/stem separation step, provides an economic advantage since it is to be expected that whole leaf would be less expensive to purchase than are the stem and lamina products of a threshing plant.

Conventional procedures can be applied to lamina materials obtained in accordance with the invention in ways similar to those in which the procedures are applied to conventionally processed cut lamina material. For example, lamina materials produced by a method in accordance with the invention can be blended in well known manner with another smoking material(s) in any ratio which is found desirable, but preferably at least the major proportion of the smoking material of the resulting blend is constituted by a lamina material obtained in accordance with the invention. Smoking materials which may be incorporated in a blend include tobacco materials, reconstituted tobacco materials and tobacco substitute materials.

Two or more lamina materials obtained in accordance with the invention can be blended.

In the blending of a United States type cigarette filler material there could be blended 1. the lamina fraction of the product provided by subjecting whole Burley tobacco to a method in accordance with the invention and 2. the product provided by subjecting Virginia tobacco leaf, at a moisture content above the transition moisture content, to a milling operation such that the product consists of a fluent mixture of lamina particles and stem particles.

The stem fraction of a product of the invention can, after separation from the lamina fraction, be processed in accordance with conventional stem processing methods, or it can be discarded.

In order that the invention may be clearly understood and readily carried into effect reference will now be made, by way of example, to the accompanying drawings, of FIGS. 1-8.

Figure 2:
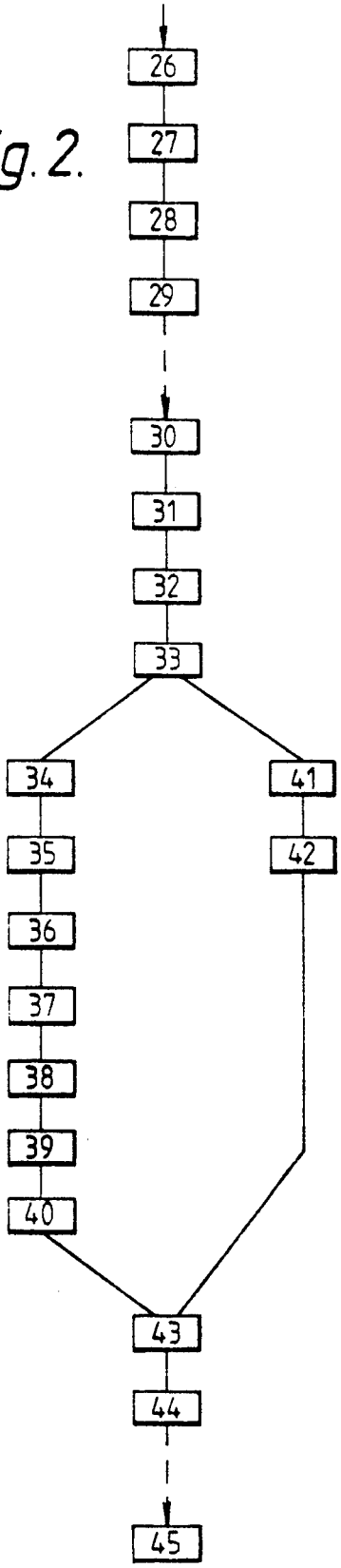
FIG. 2 is a block diagram relating to a processing of flue-cured whole tobacco leaf in accordance with the invention.
Figure 3:
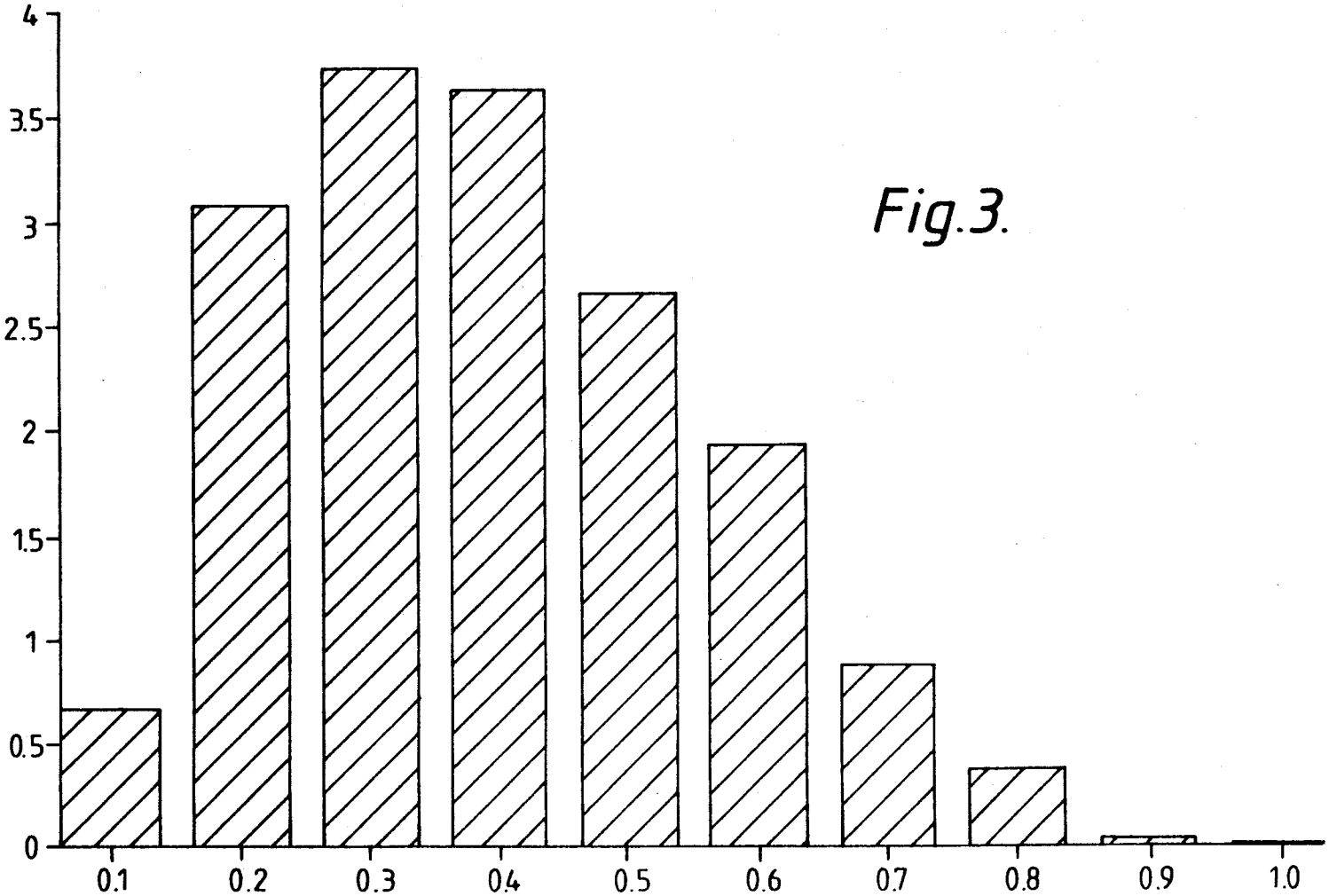
FIG. 3 is a histogram relating particle shape factor values (horizontal axis) to frequency of occurrence, measured in units of a million, (vertical axis) for a conventional cut lamina cigarette filler material.
Figure 4:
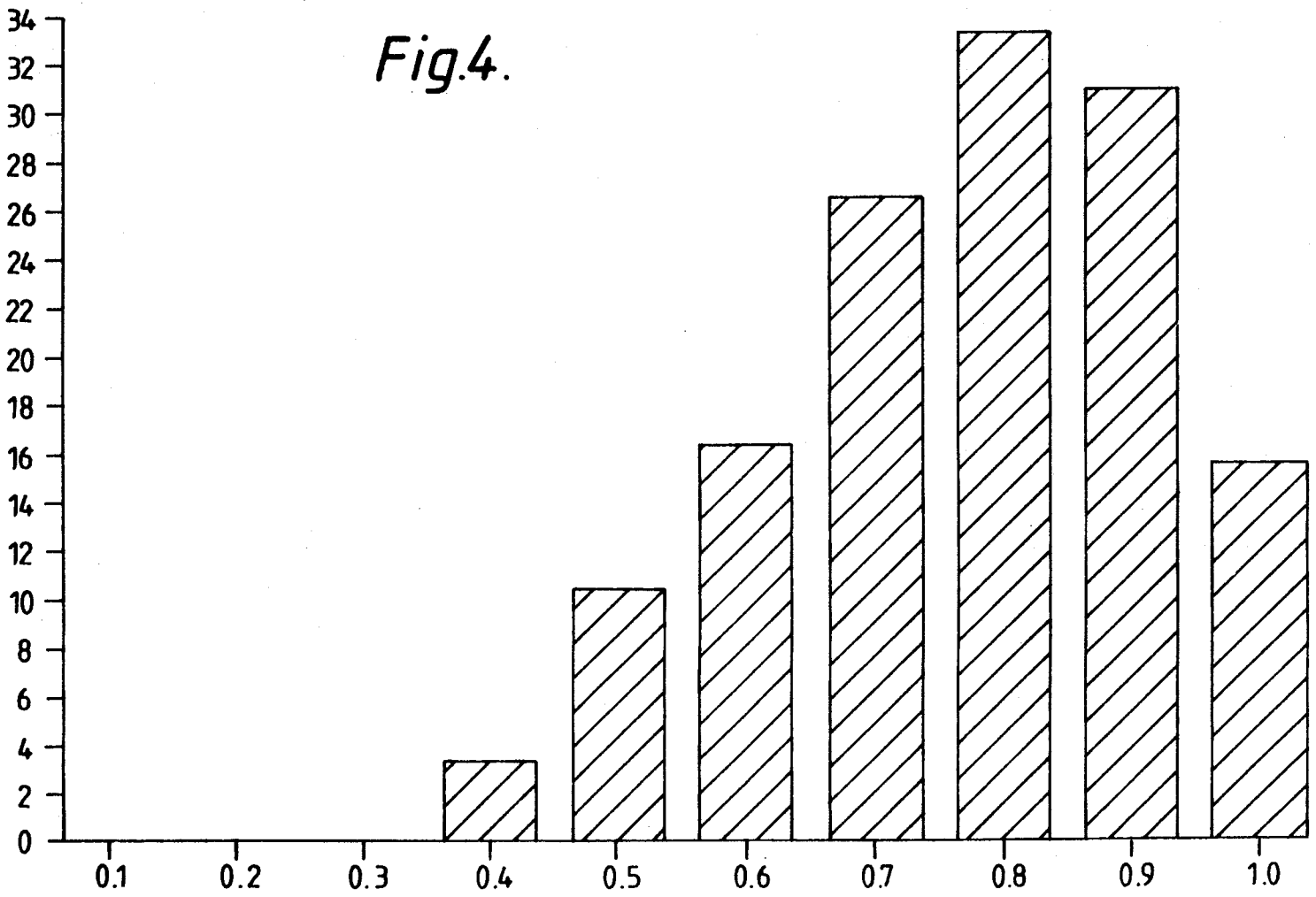
FIG. 4 is a histogram giving the same information to the same format as FIG. 3, but for a cigarette filler material which is a lamina material obtained in accordance with the invention.

[FIG. 1 is a block diagram relating to a conventional processing of flue-cured whole tobacco leaf;

FIG. 2 is a block diagram relating to a processing of flue-cured whole tobacco leaf in accordance with the invention;

FIG. 3 is a histogram relating particle shape factor values (horizontal axis) to frequency of occurrence, measured in units of a million, (vertical axis) for a conventional cut lamina cigarette filler material;

FIG. 4 is a histogram giving the same information to the same format as FIG. 3, but for a cigarette filler material which is a lamina material obtained in accordance with the invention;

Each shape factor value shown against the horizontal axes of the histograms constituting FIGS. 3 and 4 is the upper value of a unit range. Thus the value '0.4', for example, signifies that the range extends from the least value above 0.3 up to a maximum of 0.4.

Figure 5:
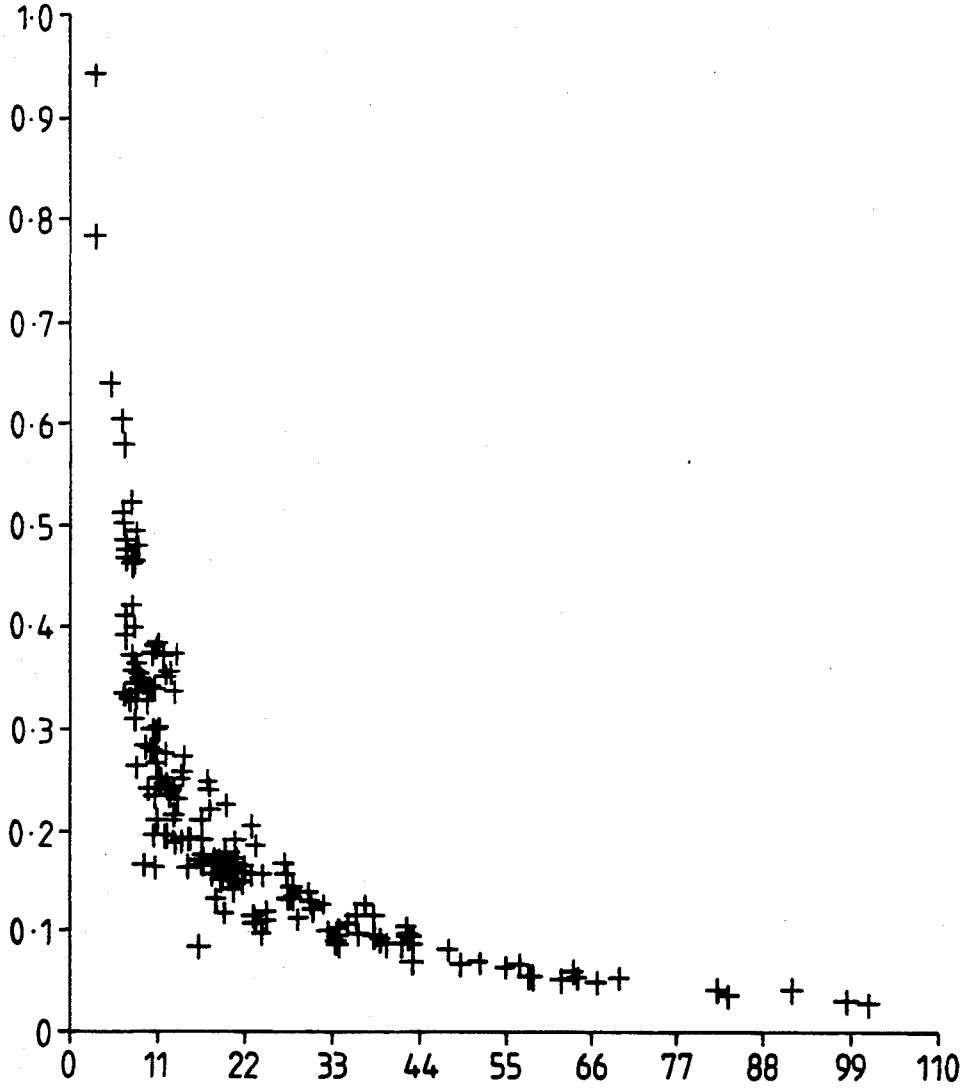
FIG. 5 is a scatter diagram relating particle length in millimeters (horizontal axis) to shape factor (vertical axis) for the conventional filler material the subject of FIG. 3.
Figure 6:
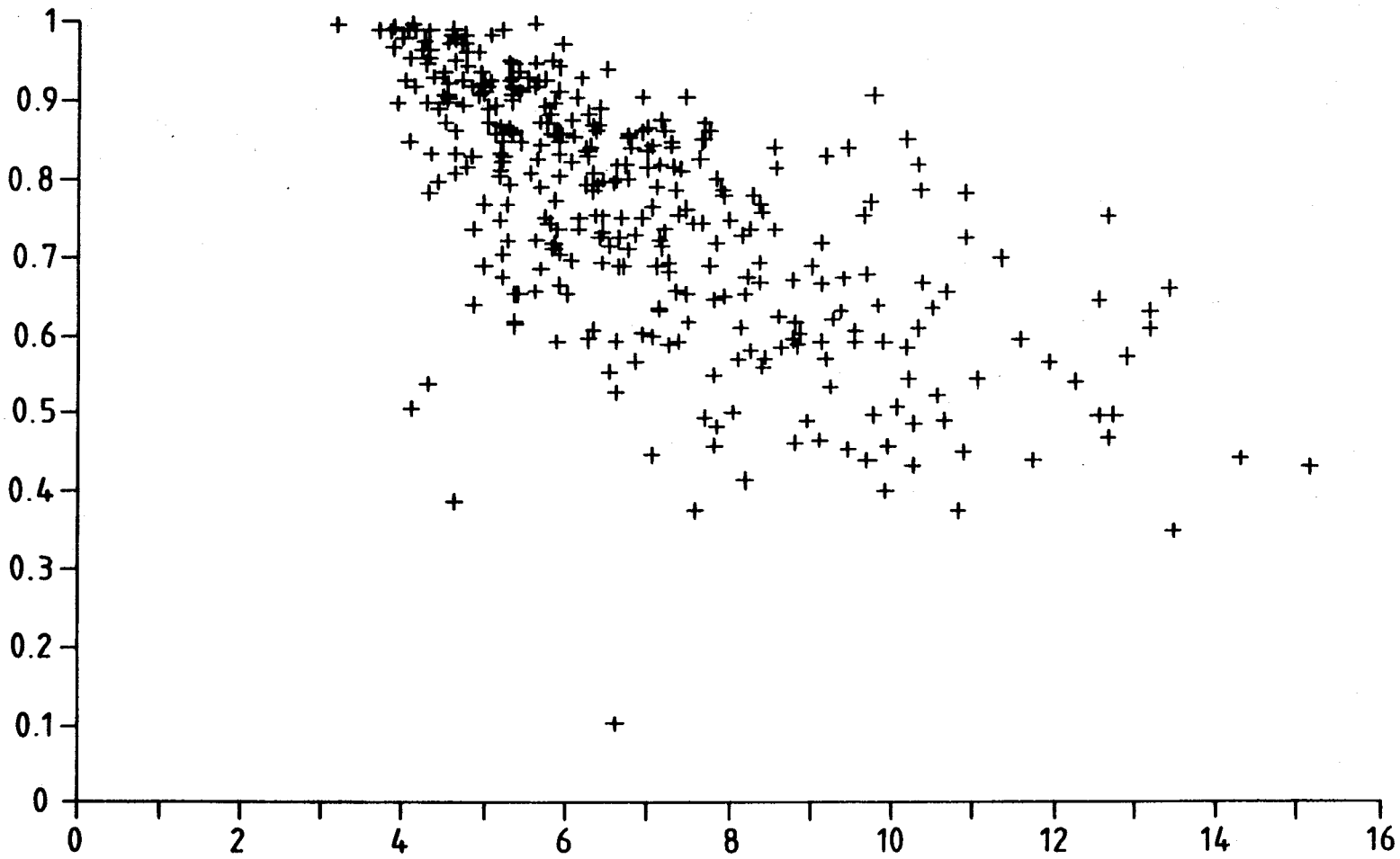
FIG. 6 is a scatter diagram relating particle length in millimeters (horizontal axis) to shape factor (vertical axis) for the filler material the subject of FIG. 4.
Figure 7:
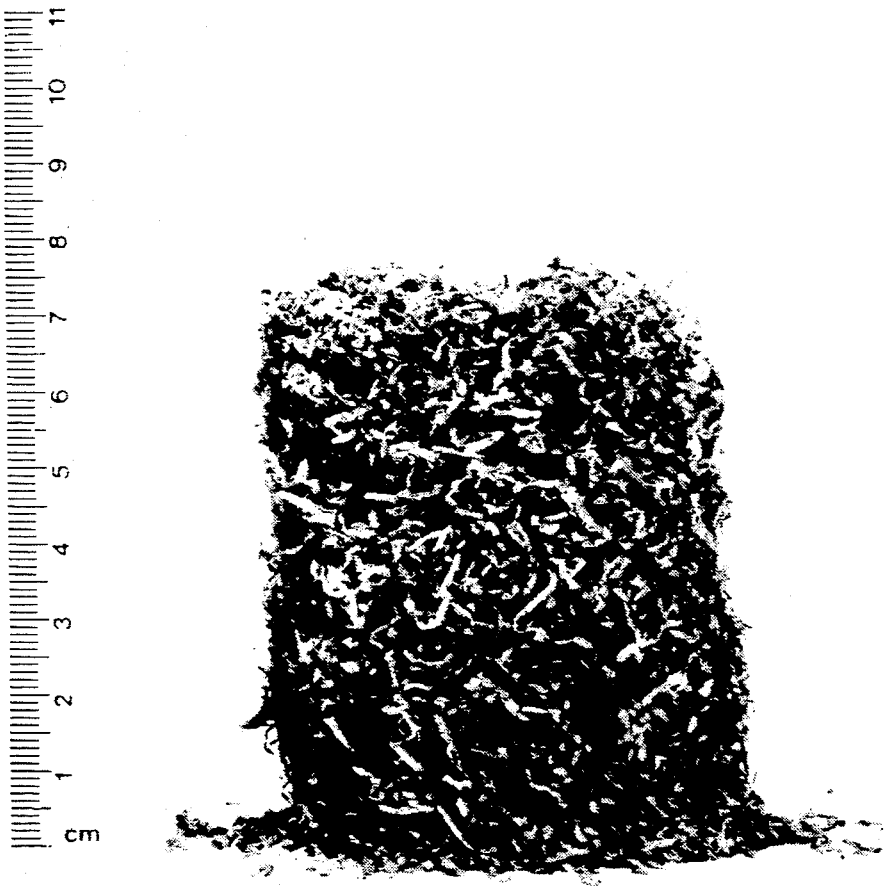
FIG. 7 shows a body of the conventional filler material the subject of FIGS. 3 and 5.
Figure 8:
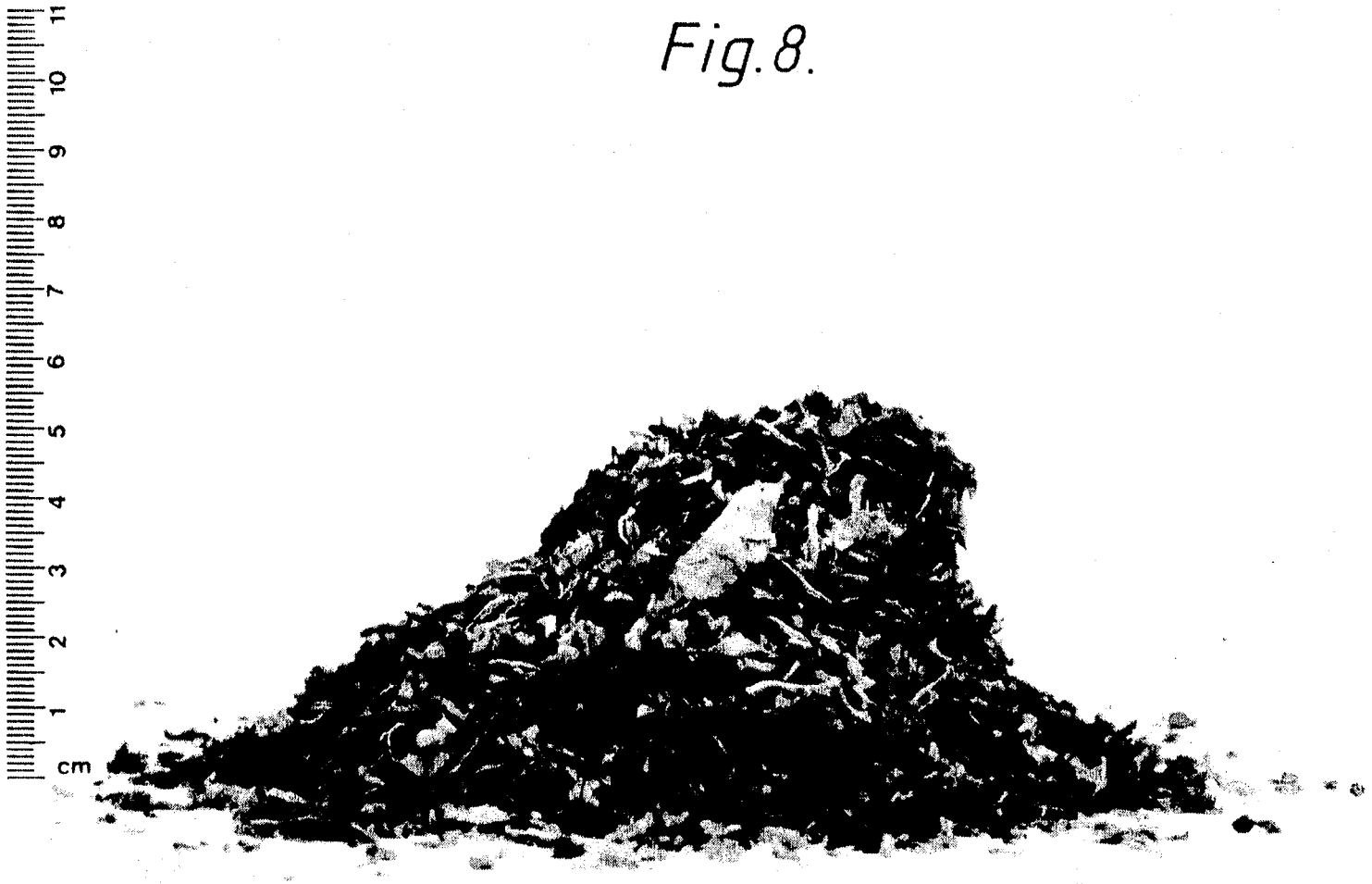
FIG. 8 shows a body of the filler material the subject of FIGS. 4 and 6.

FIG. 5 is a scatter diagram relating particle length in millimetres (horizontal axis) to shape factor (vertical axis) for the conventional filler material the subject of FIG. 3;

FIG. 6 is a scatter diagram relating particle length in millimetres (horizontal axis) to shape factor (vertical axis) for the filler material the subject of FIG. 4;

FIG. 7 shows a body of the conventional filler material the subject of FIGS. 3 and 5; and FIG. 8 shows a body of the filler material the subject of FIGS. 4 and 6.]

In FIG. 1 the reference numerals indicate the following:

1—Conditioning/Drying
2—Desanding
3—Conditioning
4—Threshing
5—Stem
6—Drying
7—Packing
8—Stem
9—conditioning
10—Blending
11—Rolling
12—Cutting
13—Water Treated stem Process (WTS)
14—Drying
15—Lamina
16—Drying
17—Packing
18—Lamina
19—Conditioning
20—Blending
21—Cutting
22—Drying
23—Blending and Adding
24—Cut Tobacco Store
25—Cigarette Making Steps 1-4, 5-7 and 15-17 take place in a tobacco growing region, whereas steps 8-14, 18-22 and 23-25 take place in a cigarette factory, which factory is commonly far remote from the tobacco growing region.

The process carried out at steps 8-14 and 18-22 constitute the primary leaf-process section of the factory, which section is sometimes referred to as the primary process department (PMD). The steps 8-14 are commonly referred to as constituting a 'stem line', and the steps 18-22 as constituting a 'lamina line'.

The word 'Adding' at step 23 refers to the possible addition of other smoking materials in the blending process of the products of the stem and lamina lines. Examples of such additional smoking materials are expanded tobacco and reconstituted tobacco.

The input material at step 1 is whole green tobacco leaf.

The overall process from step 1 to step 25 could be varied in detail, but FIG. 1 illustrates a typical prior art conventional processing of tobacco leaf material to provide cigarette filler.

In FIG. 2 the reference numerals indicate the following:

26—Conditioning/Drying
27—Desanding
28—Drying
29—Packing
30—Whole Leaf
31—Conditioning
32—Blending
33—Milling and Classifying
34—Stem
35—Conditioning
36—Blending
37—Rolling
38—Cutting
39—Water Treated Stem Process (WTS)
40—Drying
41—Shattered Lamina
42—Drying
43—Blending and Adding
44—Buffer Store
45—Cigarette Making Steps 26-29 take place in the tobacco growing region and steps 30-45 take place in a cigarette factory.

The conditioning steps are carried out in such manner as to avoid, or substantially avoid, the removal of water extractible components.

The input material at step 26 is whole green tobacco leaf.

Details will now be given of experiments relating to the invention.

EXPERIMENT 1

The tobacco leaf material used in this experiment was a single grade of Canadian flue-cured whole green leaf, which was purchased in farm bales of a moisture content of about 18%. The bales were sliced using a guillotine slicer to provide large leaf portions, in accordance with the definition of 'whole leaf' hereinabove, the majority of which portions were about 10 cm to about 20 cm wide.

Figure 12:
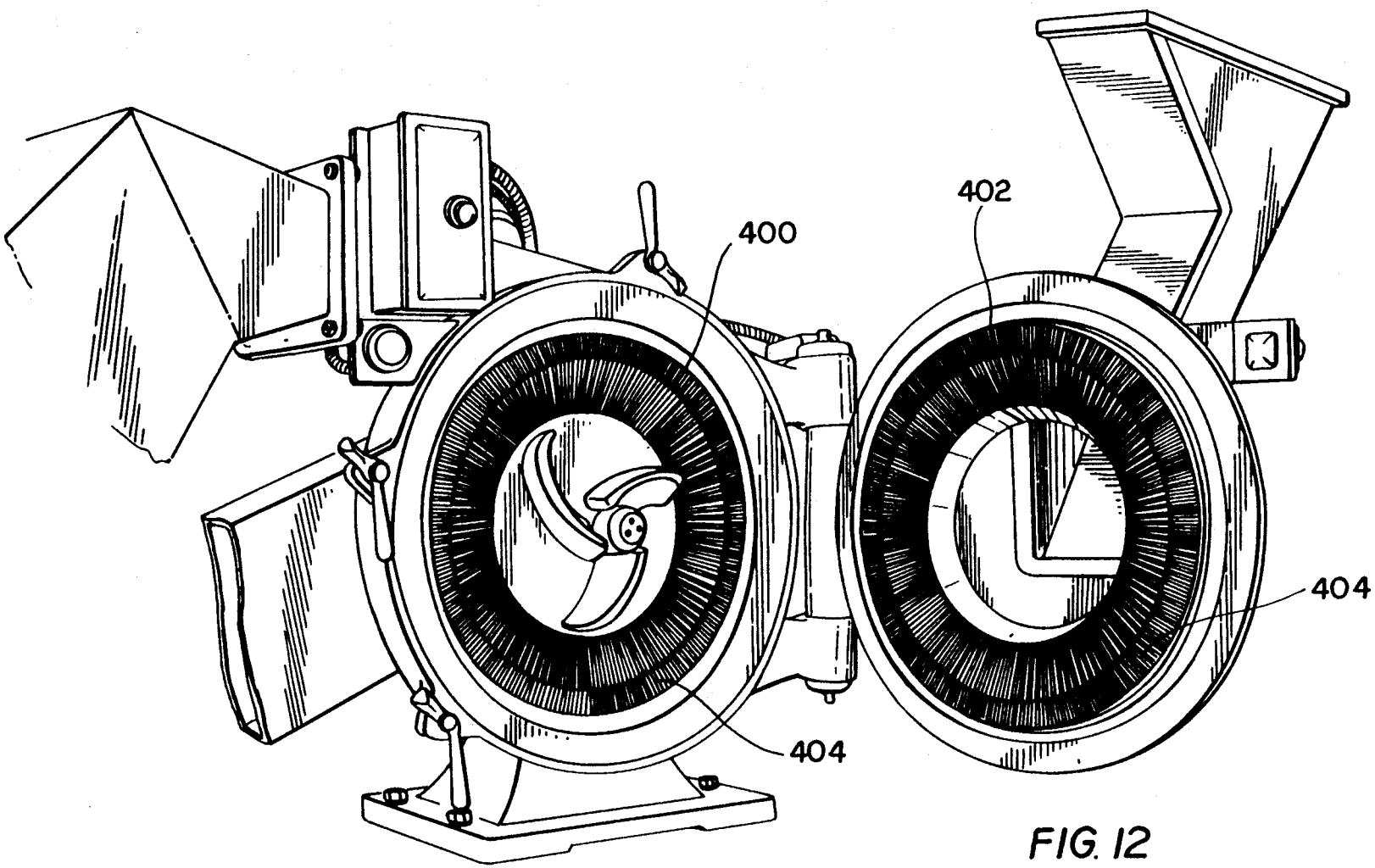
FIG. 12 PRIOR ART
FIG. 12 is a view of a prior art Quester disc refiner SM II, in the open position.

The whole leaf material thus obtained, at a mean moisture content of about 18% was then gravity fed at a nominal rate of 150 kg/hr, to a Quester disc mill (model SM[11] II; see FIG. 12). The rotatable disc of the mill was driven at 1,000 r.p.m. The rotatable disc (400) and the stationary 'disc' or plate (402), which were the standard such items for model SM II, comprised, at the operative, opposed faces thereof, a pattern of radially extending, linear, rib-form projections (404).

The mill was operated at a nominal disc gap of 0.15 mm, and then at 0.15 mm increments of disc gap up to a nominal disc gap of 0.60 mm. Steam was supplied to the interior of the mill at 1 bar pressure.

The product obtained at each of the disc gap settings consisted of a mixture of lamina particles and intact lengths of stem. In each case the particle size of the lamina fraction was adjudged to be such that the lamina fractions, after separation from the stem lengths, would be suitable for the manufacture of cigarettes on a conventional cigarette rod making machine. The stem pieces were clean, i.e. no remnant portions of lamina remained attached thereto.

EXPERIMENT 2

Experiment 1 was repeated excepting that the nominal disc gaps were 0.9, 1.2, 1.5, 1.8. and 2.1 mm. The products obtained from these five runs again consisted of a mixture of lamina particles and intact lengths of stem. As the disc gap increased, the particle size of the lamina fraction increased and it was adjudged that at least for the runs at the larger disc gaps, some further size reduction of the lamina fraction would be required in order to render the lamina fraction suitable for feeding to a cigarette making machine. At the larger disc gap settings some of the stem pieces had remnant portions of stem attached thereto.

EXPERIMENT 3

Experiment 1 was repeated with the whole leaf material conditioned to a moisture content of 20% and with a feed rate of 330 kg/hr. Runs were made at nominal disc gap settings of 0.30 mm and 1.20 mm. When the nominal gap was 0.30 mm, the product consisted of an intimate, fluent mixture of lamina particles and stem particles. The product obtained when the nominal disc gap was 1.20 mm was, however, in accordance with the invention and comprised a mixture of lamina particles and intact stem lengths. It was thus concluded that the 20% moisture content value was below the transition moisture content value prevailing for the conditions appertaining to the experiment, when including a disc gap of 1.20 mm.

EXPERIMENT 4

Experiment 1 was repeated with the whole leaf material conditioned to a moisture content of 21% and with a nominal disc gap of 1.05 mm. The product was in accordance with the invention and comprised a mixture of lamina particles and intact stem lengths.

EXPERIMENT 5

This experiment was performed as per Experiment 4 except that the whole leaf material was conditioned to a moisture content of 24%. The product consisted of an intimate, fluent mixture of lamina particles and stem particles. It was thus concluded that the 24% moisture content value was above the prevailing transition moisture content value.

EXPERIMENT 6

The tobacco materials used in this experiment were three redried Zimbabwean flue-cured grades. Each grade was bale sliced and the whole leaf materials of the three grades were then blended and conditioned to a target moisture content of 22%. The blend was then fed, at a nominal feed rate of 300 kg/hr, to a Bauer model 400 disc mill with a disc gap of 2.54 mm and a drive speed of 700 r.p.m. for each of the two discs. The discs comprised, at the operative faces thereof, a pattern of radially extending, linear, ribform projections. The product thus obtained comprised a mixture of lamina particles and intact stem lengths. The lamina fraction was adjudged suitable for the manufacture of cigarettes on a conventional cigarette rod making machine.

EXPERIMENT 7

A 100 g sample of conventional U.S. flue cured cut lamina material was sieved using a sieve test apparatus comprising a box in which are disposed, one above another, five horizontally extending mesh sieves. The nominal apertures of the mesh sieves, from the top sieve down, are 1.98, 1.40, 1.14, 0.81 and 0.53 mm. The sieve test apparatus comprises reciprocative means operative to reciprocate the box and the sieves therein. The 100 g sample was evenly distributed on the upper sieve and the reciprocative means was put into operation for 10 minutes, after which time period the material fractions on the upper four sieves were recovered. The fraction on the lowermost sieve and the fraction that had passed through the lowermost sieve were of a fine dust form and were disregarded.

0.5 g sub-samples of the four recovered fractions were distributed on respective flat surfaces such that each lamina particle was spacially separated from the other particles. Each of the sub-samples was then subjected to geometric analysis by use of a Magiscan Image Analyser model 2 supplied by Joyce-Loebl; Marquisway, Team Valley, Gateshead, Tyne & Wear NE11 OQW, England. The analyser was set to obtain data as to particle area (two dimensional), length (greatest linear dimension) and perimeter length.

From the data thus obtained there were produced a histogram relating particle shape factor to frequency of occurrence (FIG. 3) and a scatter diagram relating particle length to shape factor (FIG. 5).

EXPERIMENT 8

A 100 g sample of a lamina fraction of a product according to the invention, which product was obtained by milling U.S. flue cured whole leaf material at 18% moisture content in the Quester mill at a 0.3 mm disc gap, was subjected to the sieving procedure detailed in Experiment 7. Four 0.5 g sub-samples, from the upper four sieves, i.e. dust free, were geometrically analysed as per Experiment 7.

From the data thus obtained there were produced the shape factor/frequency histogram and the length/shape factor scatter diagram which constitute FIGS. 4 and 6 respectively.

A comparison between the histograms of FIGS. 3 and 4 shows the lamina fraction of the product of the invention (FIG. 4) to be of a distinctly different character from the conventional cut lamina material (FIG. 3). In this regard it may be observed, for example, that for the cut lamina material about 80% of the material, on a dust free basis, had a shape factor of 0.5 or less, whereas for the lamina material obtained by use of the invention about 90% of the material had a shape factor of 0.5 or above.

The distinctly different character of the two materials is also readily discerned from a perusal of FIGS. 5 and 6.

EXPERIMENT 9

Conventional cut lamina material, of a blend of three redried Zimbabwean grades, at a moisture content of about 12.5% was placed in a 125 ml laboratory beaker without the application to the material in the beaker of any external compactive pressure. The beaker was then upturned on a flat, horizontal surface and the beaker was removed by lifting same vertically. The resultant body of cut lamina material is as depicted in FIG. 7. As may be observed, the angle of repose of the material is about 90 degrees to the horizontal.

EXPERIMENT 10

Experiment 9 was repeated using a lamina material obtained by use of the invention, as applied to a whole leaf blend of the same three Zimbabwean grades, at a moisture content of about 12.5%. The resultant body of material is as depicted in FIG. 8. The angle of repose is about 33 degrees to the horizontal.

A comparison of FIGS. 7 and 8 again strongly evidences the very different characteristics of conventional lamina material and a lamina material obtained by use of the invention.

What is claimed is:

1. A method of processing whole leaf tobacco, which comprises feeding tobacco as whole leaf through a mill wherein the moisture content of at least a major proportion of the tobacco leaf is below the transition moisture content, the arrangement of said mill and the processing conditions being such that there exits said mill a tobacco product which is a mixture comprising flakes of tobacco leaf lamina and substantially intact tobacco leaf stem pieces, the lamina fraction of said product requiring substantially no further size reduction in order to render the lamina fraction suitable for being incorporated in smoking articles.

2. A method according to claim 1, wherein lamina strips are fed to said mill together with the whole leaf tobacco.

3. A method according to claim 1, wherein the lamina fraction of said product, after separation from said stem pieces, is fluent.

4. A method according to claim 1, wherein the tobacco leaf material fed to said mill is gravity fed thereto.

5. A method according to claim 1, wherein said mill comprises first and second leaf reduction elements, a material flow path between and across opposed faces of said elements, and drive means operative to cause relative movement between said elements.

6. A method according to claim 5, wherein at least one of said elements is discoid.

7. A method according to claim 5, wherein said faces are substantially conoidal.

8. A method according to claim 5, wherein said elements, at the said opposed faces thereof, comprise projections.

9. A method according to claim 8, wherein said projections are of generally linear configuration and said projections are disposed perpendicularly of the direction of said relative movement between said elements.

10. A method according to claim 5, wherein said drive means is operative to drive one only of said elements.

11. A method according to claim 5, wherein said drive means is operative to drive both of said elements.

12. A method according to claim 5, wherein said relative movement is rotative relative movement.

13. A method according to claim 1, wherein during the passage of the leaf material through said mill, low pressure steam is brought into contact with said leaf material.

14. A method according to claim 1, wherein the flow of the leaf material to and through said mill is assisted by the maintenance at the product outlet of said apparatus of a reduced air pressure.

15. A method according to claim 1, wherein prior to the leaf material being fed to said mill, said leaf material or a part thereof is treated with a smoke modifying agent.

16. A method according to claim 1, wherein the lamina fraction of said product is subjected to a tobacco expansion process.

17. A method according to claim 1, wherein the lamina fraction of said product is incorporated in smoking articles.

18. A method according to claim 17, said smoking articles being cigarettes.

19. A method according to claim 17, said smoking articles being cigars.

20. A method according to claim 17, 18 or 19, wherein said lamina fraction is fed to a smoking article making machine.

21. A method according to claim 20, wherein, prior to being fed to said making machine, said lamina fraction is subjected to a minor degree of further particle size reduction.

22. A method according to claim 17, wherein before said lamina fraction is incorporated in smoking articles, said lamina fraction is blended with another smoking material.

23. A smoking article comprising a smoking material which is the product of a method of processing tobacco leaf material according to claim 1.

24. A smoking article according to claim 23 and being a cigarette.

25. A smoking article according to claim 23 and being a cigar.

26. A tobacco product according to claim 1 which comprises; a mixture of tobacco leaf lamina particles and tobacco leaf stem pieces; about 70 percent or more of the dust free tobacco leaf lamina particles having a shape factor of 0.5 or above.

27. A tobacco product according to claim 1 which comprises; a mixture of tobacco leaf lamina particles and tobacco leaf stem pieces; the lamina fraction of the mixture having a Borgwaldt filling value which is less than that of comparable conventional cut tobacco leaf lamina cigarette filler material.

28. The product of the process of claim 1.

29. A tobacco product which comprises; a mixture of tobacco leaf lamina particles and substantially intact tobacco leaf stem pieces, which mixture has an angle of repose of not more than about 45 degrees to the horizontal.

30. A product according to claim 29, the said angle of repose being not more than about 35 degrees to the horizontal.

31. A product according to claim 29, the shape factor of about 70 percent or more of the dust free particles of the lamina fraction of which is 0.5 or above.

32. A product according to claim 31, the shape factor of about 80 percent or more of the dust free particles of said lamina fraction being 0.5 or above.

33. A product according to claim 29, the Borgwaldt filling value of the lamina fraction of which is less than that of comparable conventional cut lamina cigarette filler material.

34. A tobacco smoking article which comprises; a product according to claim 28 in the form of a rod.

35. A smoking article according to claim 34 and being a cigarette.

36. A smoking article according to claim 34 and being a cigar.

37. A method of processing whole tobacco leaf material to provide smoking article filler material, wherein tobacco as whole leaf passes through a passage defined by co-extensive portions of first and second, relatively moving, milling elements of a mill from an inlet of said passage to an outlet of said passage remote said inlet, so as to provide at said outlet a product comprising a mixture of lamina particles and intact stem pieces, the lamina particles and the stem pieces being separated, whereby the lamina particle fraction, absent the stem pieces, constitutes the filler material.

38. A method according to claim 37, wherein said outlet is situated at a location which is a limiting location of the co-extensivity of said portions.

39. Smoking article filler material the product of a method according to claim 37.

40. A method of making smoking articles, wherein filler material the product of the method according to claim 37 is fed to a smoking article making machine.

41. A smoking article, which smoking article is the product of the method according to claim 40.

42. Smoking article filler material, which filler material is a fluent material consisting of lamina particles the shape factor of about 70 percent or more of the dust free particles being 0.5 or above.

43. A method of making smoking articles, wherein filler material according to claim 42 is fed to a smoking article making machine.

44. A smoking article, which smoking article is the product of the method according to claim 43.

45. A method of making cigarettes, wherein tobacco bale material is reduced to provide discrete whole leaf; the whole leaf is fed through a mill such that there exits said mill a product which is a mixture comprising flakes of lamina and substantially intact lengths of stem; the lamina and stem fractions of said mixture are separated; and the lamina fraction is fed to a cigarette rod making machine.

* * * * *